US010170858B2

(12) United States Patent
Tanikawa

(10) Patent No.: US 10,170,858 B2
(45) Date of Patent: Jan. 1, 2019

(54) LEVER-TYPE CONNECTOR

(71) Applicant: Sumitomo Wiring Systems, Ltd., Yokkaichi, Mie (JP)

(72) Inventor: Naotaka Tanikawa, Mie (JP)

(73) Assignee: SUMITOMO WIRING SYSTEMS, LTD., Yokkaichi, Mie (JP)

( * ) Notice: Subject to any disclaimer, the term of this patent is extended or adjusted under 35 U.S.C. 154(b) by 0 days.

(21) Appl. No.: 15/752,646

(22) PCT Filed: Aug. 18, 2016

(86) PCT No.: PCT/JP2016/074064
§ 371 (c)(1),
(2) Date: Feb. 14, 2018

(87) PCT Pub. No.: WO2017/043279
PCT Pub. Date: Mar. 16, 2017

(65) Prior Publication Data

US 2018/0241152 A1 Aug. 23, 2018

(30) Foreign Application Priority Data

Sep. 7, 2015 (JP) ..... 2015-175433

(51) Int. Cl.
*H01R 13/62* (2006.01)
*H01R 13/629* (2006.01)
*H01R 13/631* (2006.01)

(52) U.S. Cl.
CPC . *H01R 13/62955* (2013.01); *H01R 13/62938* (2013.01); *H01R 13/631* (2013.01)

(58) Field of Classification Search
CPC ..... H01R 13/62955; H01R 13/62938; H01R 13/629556; H01R 13/62933; H01R 13/631; H01H 9/102
See application file for complete search history.

(56) References Cited

U.S. PATENT DOCUMENTS 6,623,285 B2 * 9/2003 Nishide ..... H01R 13/62933 439/140
9,373,913 B2 * 6/2016 Noda ..... H01R 13/62938
(Continued)

FOREIGN PATENT DOCUMENTS

| | | |
|---|---|---|
| JP | 9-199233 | 7/1997 |
| JP | 2012-109174 | 6/2012 |
| JP | 2012-238498 | 12/2012 |

OTHER PUBLICATIONS

International Search Report dated Nov. 15, 2016.

*Primary Examiner* — Jean F Duverne
(74) *Attorney, Agent, or Firm* — Gerald E. Hespos; Michael J. Porco; Matthew T. Hespos

(57) ABSTRACT

A lever-type connector (10) includes a housing (20) and a lever (40) mounted on the housing (20) movably to an initial position, a first connection position and a second connection position. The lever (40) includes a deflecting portion (45) deflectable in a moving direction of the lever (40). The housing (20) includes a projecting portion (25) configured to start contacting the deflecting portion (45) halfway through a movement of the lever (40) from the initial to the first connection position and deflect the deflecting portion (45) until the second connection position is reached and a lever lock portion (24) configured to hold the lever (40) in a movable state between the first connection position and the second connection position. The lever (40) includes a receiving portion (46) configured to contact not the lever lock portion (24), but the projecting portion (25) when the second connection position is reached.

4 Claims, 6 Drawing Sheets

(56) References Cited

U.S. PATENT DOCUMENTS

| | | | | |
|---|---|---|---|---|
| 2008/0064242 | A1* | 3/2008 | Shishikura | H01R 13/62955 439/157 |
| 2008/0102666 | A1* | 5/2008 | Yamashita | H01R 13/62938 439/157 |
| 2008/0119074 | A1* | 5/2008 | Okano | H01R 13/4538 439/140 |
| 2008/0248664 | A1* | 10/2008 | Shibata | H01R 13/62938 439/157 |
| 2009/0263997 | A1* | 10/2009 | Tonosaki | H01R 13/62938 439/157 |
| 2012/0129381 | A1 | 5/2012 | Makino | |
| 2012/0289070 | A1 | 11/2012 | Uchida | |
| 2013/0237078 | A1* | 9/2013 | Ikeda | H01H 9/102 439/157 |
| 2014/0248788 | A1* | 9/2014 | Kodama | H01R 13/62938 439/310 |

* cited by examiner

LEVER-TYPE CONNECTOR

BACKGROUND

Field of the Invention

This specification relates to a lever-type connector.

Description of the Related Art

Japanese Unexamined Patent Publication No. H09-199223 discloses a lever-type connector with a housing and a lever piece mounted to straddle the housing. The housing includes a terminal accommodating portion for accommodating terminal fittings, and a cover is mounted on the terminal accommodating portion from behind. The cover is provided with an unlocking piece lockable to a locking piece provided on the lever. The locking piece includes a projection projecting rearward, and the unlocking piece is provided with an engaging projection engageable with the projection. The lever is set at an initial position and a mating connector and the lever-type connector are lightly connected. The lever then is rotated in a clockwise direction so that the connection of the mating connector and the lever-type connector proceeds. When the connection is completed, the projection of the locking piece and the engaging projection of the unlocking piece are engaged to lock the rotation of the lever.

Although the unlocking piece is provided on the cover in the above lever-type connector, the unlocking piece may be provided on the housing in some cases. Specifically, the unlocking piece may be cantilevered rearward from the rear surface of the housing. In this configuration, in the case of an overstroke despite the completion of the connection by the rotation of the lever, the unlocking piece may be deflected by being pressed by the lever to disengage the projection of the locking piece and the engaging projection of the unlocking piece. If the projection and the engaging projection are disengaged, the lever is returned in a counterclockwise direction by a reaction force of a leaf spring provided on the lever.

SUMMARY

A lever-type connector disclosed by this specification has a housing, and a lever mounted on the housing movably to an initial position, a first connection position and a second connection position more distant from the initial than the first connection position. The lever includes a deflecting portion deflectable in a moving direction of the lever. The housing includes a projection configured to start contacting the deflecting portion halfway through a movement of the lever from the initial position to the first connection position and to deflect the deflecting portion until the second connection position is reached. A lever lock is configured to hold the lever in a movable state between the first connection position and the second connection position, and the lever includes a receiving portion configured not to contact the lever lock, but to contact the projection when the second connection position is reached.

In this configuration, the deflecting portion contacts the projection halfway through the movement of the lever from the initial position to the first connection position. Additionally, the deflecting portion is deflected by the projection when the lever is moved farther and the lever is held by the lever lock when the lever reaches the first connection position.

The lever is returned toward the initial position by a reaction force of the deflecting portion if the movement of the lever is stopped before the first connection position is reached. Thus, it can be detected that the lever has not reached the first connection position. On the other hand, if a lever operating force is large and the lever reaches the second connection position (in the case of an overstroke), the receiving portion of the lever contacts the projecting portion, thereby stopping the movement of the lever. In this situation, the lever does not contact the lever lock, and the lever lock can be prevented from being deformed due to stress applied thereto. Thus, it can be prevented that the lever held by the lever lock is released and the lever is returned toward the initial position.

The projection may include a stopper configured to deflect the deflecting portion and a movement stopping portion configured to stop a movement of the lever while contacting the receiving portion. The stopper and the movement stopping portion may be provided at different positions on an outer peripheral surface of the projecting portion. According to this configuration, both the stopper and the movement stopping portion are provided on the projection. Thus, miniaturization is possible as compared to the case where the stopper and the movement stopping portion are provided on different parts.

The lever may include two cam plates having two of the deflecting portions and an operating portion coupling the cam plates. The lever may be held with the operating portion locked by the lever lock. According to this configuration, the lever lock is provided according to the position of the operating portion. Thus, a case where the cantilevered lever lock has to be provided is assumed. Even in such a case, no stress is applied to the lever lock, and the lever lock will not be defomed.

According to this specification, it is possible to prevent the lever lock from being deformed in a way that could release the lever held by the lever lock if there is an overstroke of the lever.

DETAILED DESCRIPTION

Figure 1:
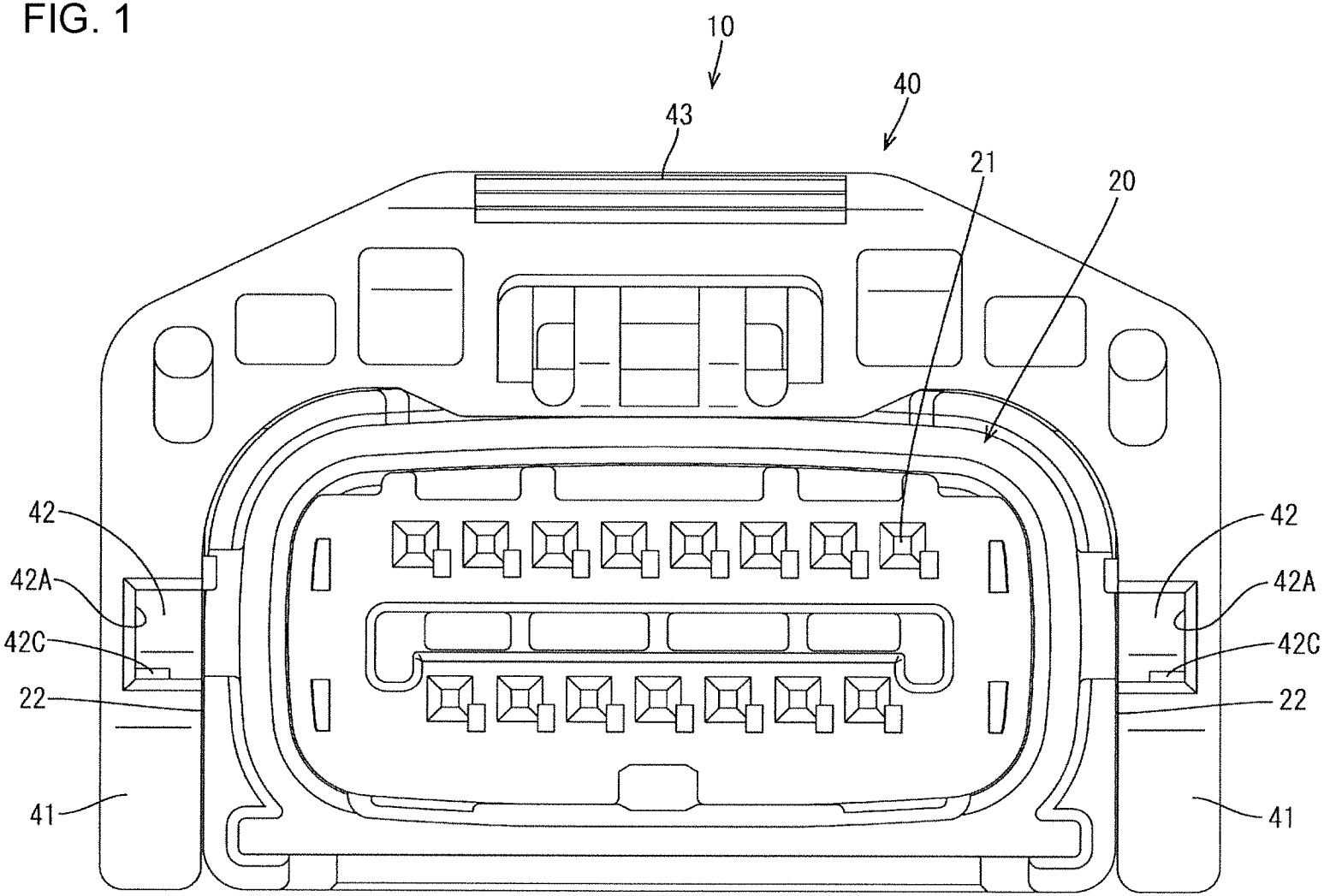
FIG. 1 is a front view of a lever-type connector in an embodiment.

An embodiment is described with reference to FIGS. 1 to 6. A lever-type connector 10 of this embodiment includes a housing 20 and a substantially gate-shaped lever 40 mounted on the housing 20 as shown in FIG. 1. The lever 40 is mounted on the housing 20 rotatably to an initial position shown in FIG. 3, a first connection position shown in FIG. 4 and a second connection position shown in FIG. 5. The second connection position is slightly more distant from the initial position than the first connection position. In other words, the second connection position can be said to be a position reached by an overstroke of the lever 40 from the first connection position.

Figure 3:
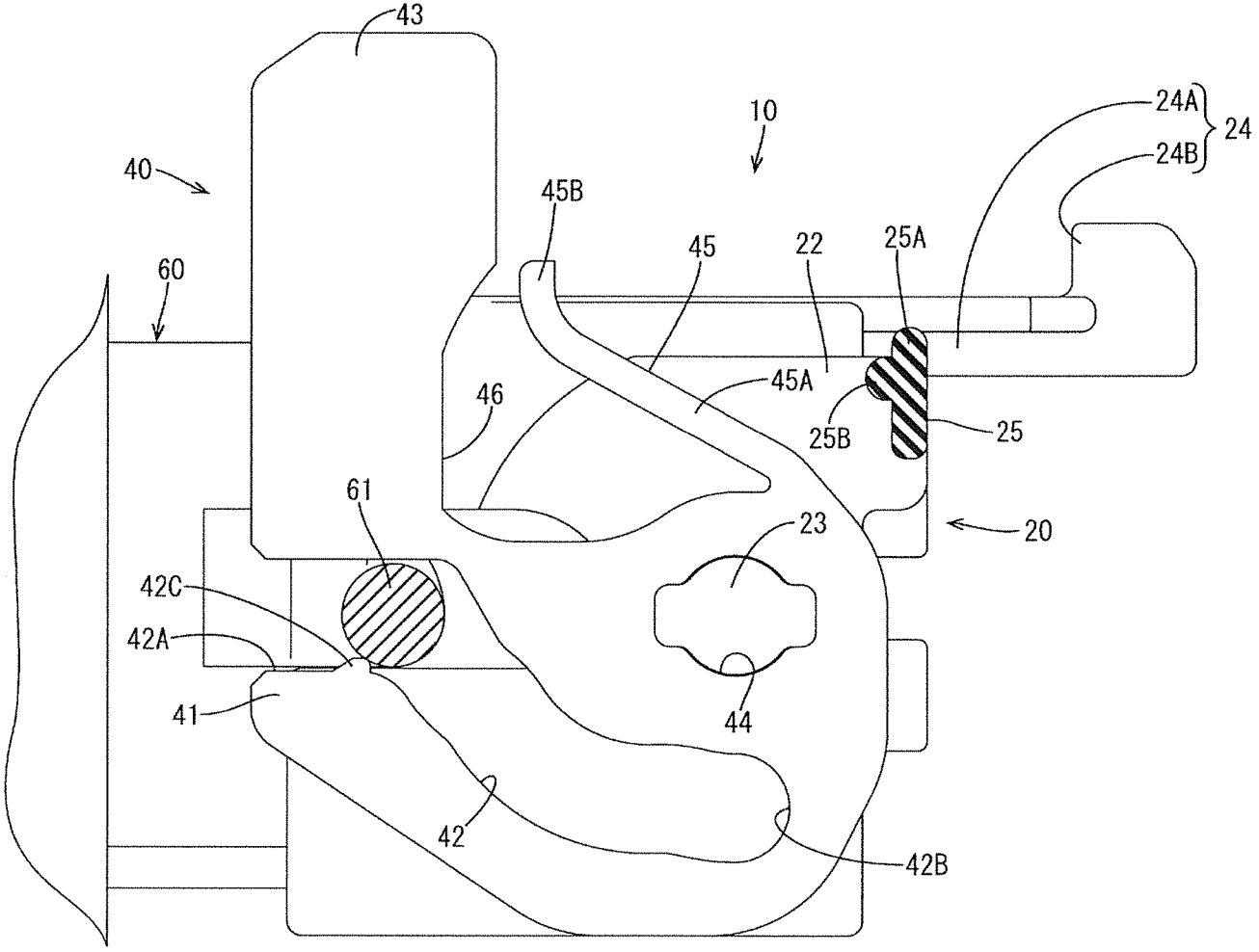
FIG. 3 is a section of the lever-type connector showing the state where the lever is at the initial position.
Figure 4:
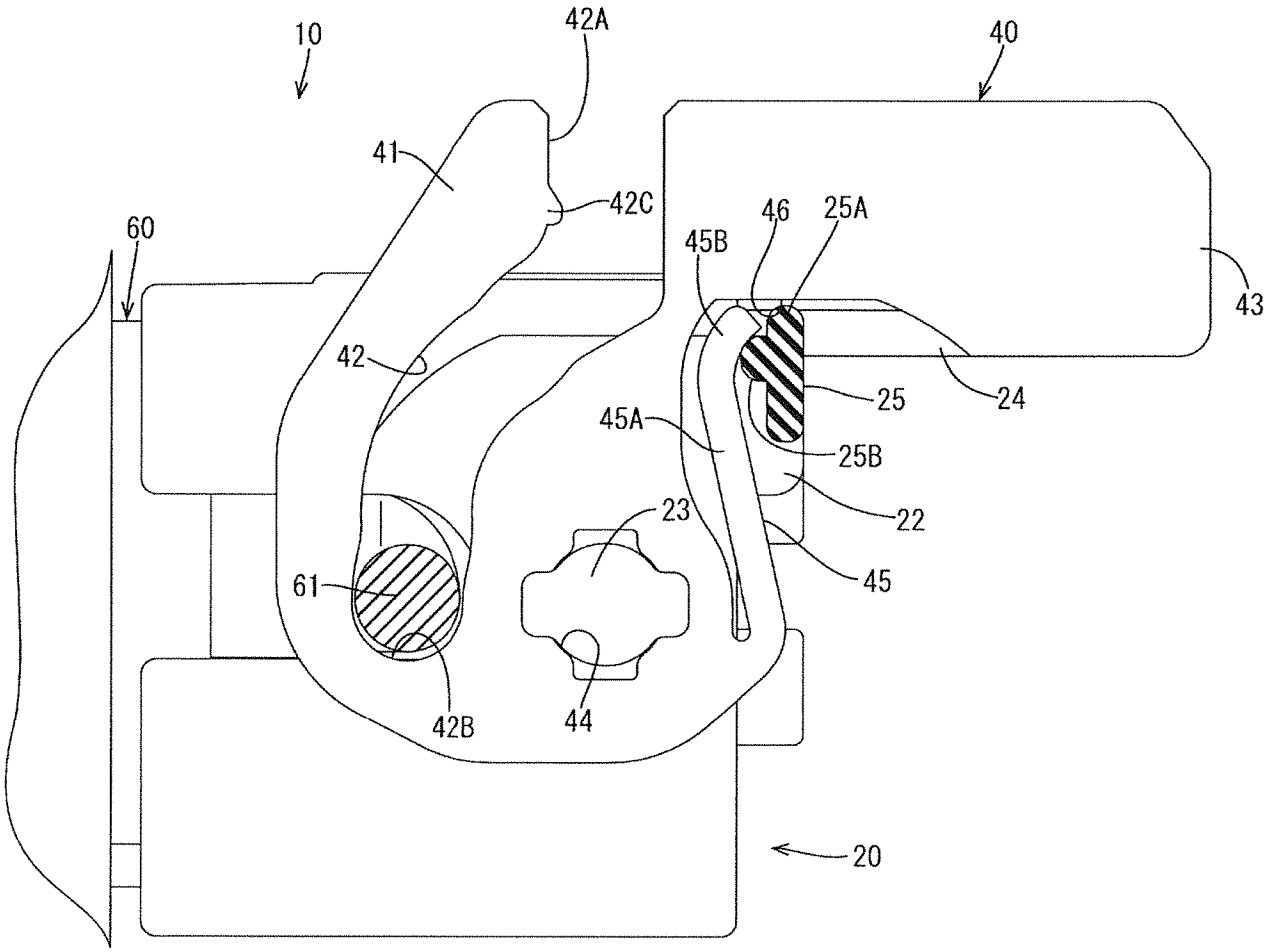
FIG. 4 is a section of the lever-type connector showing a state where the lever is at a first connection position.

As shown in FIG. 3, the connection of the housing 20 and a mating housing 60 proceeds by rotating the lever 40 from the initial position toward the first connection position with the housing 20 and the mating housing 60 lightly connected. The housing 20 and the mating housing 60 reach a connected state when the lever 40 reaches the first connection position as shown in FIG. 4. The housing 20 and the mating housing 60 are separated by rotating the lever 40 from the first connection position toward the initial position with the housing 20 and the mating housing 60 connected.

Figure 2:
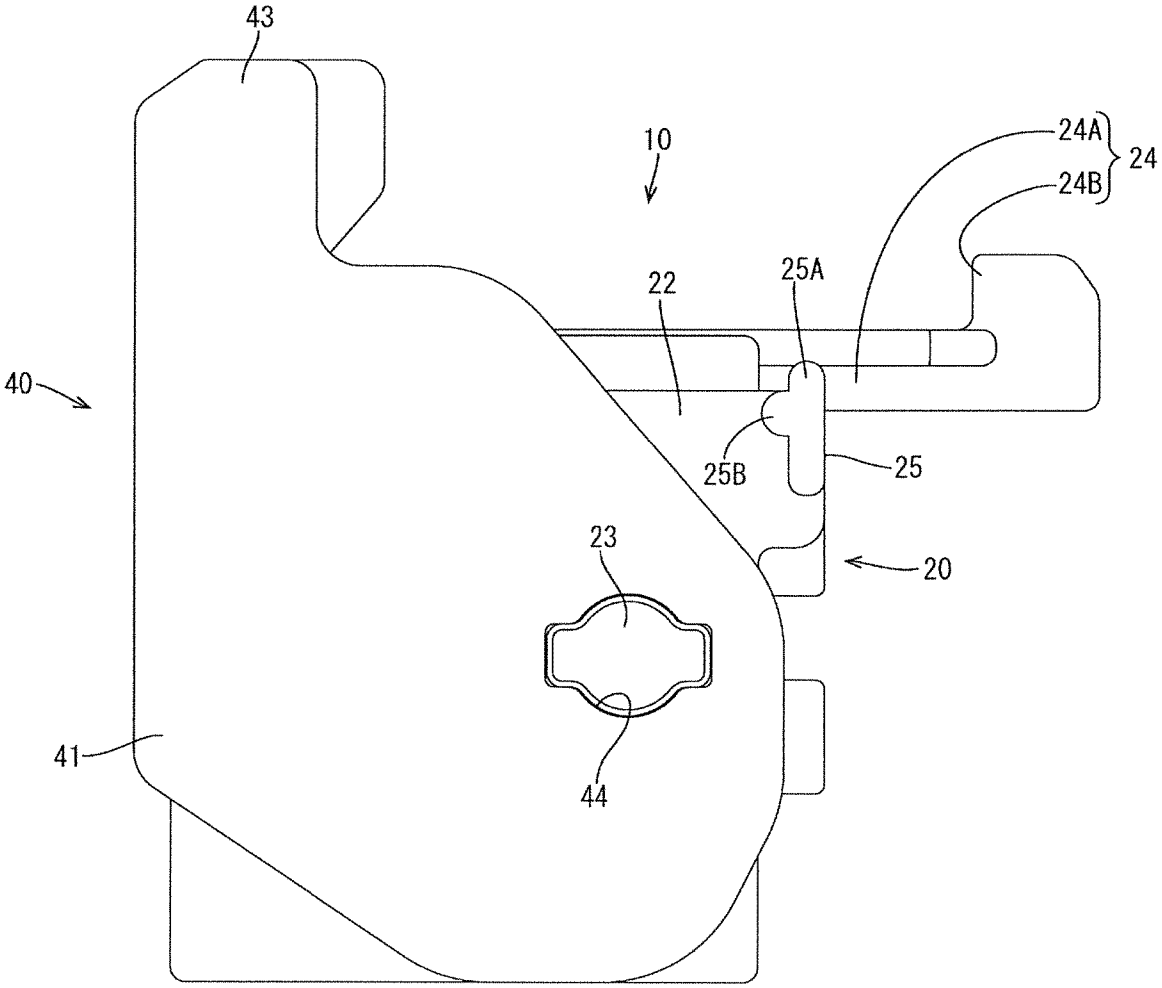
FIG. 2 is a side view of the lever-type connector showing a state where a lever is at an initial position.

The housing 20 is made of synthetic resin and cavities 21 for accommodating unillustrated terminals are provided inside the housing 20. The cavities 21 are provided side by side in a lateral direction in upper and lower stages. As shown in FIG. 2, a support shaft 23 is provided on each side surface 22 of the housing 20 for rotatably supporting the lever 40 so that two support shafts 23 are provided in total. As shown in FIG. 1, the housing 20 is bilaterally symmetrical when viewed from the front. Thus, one side surface 22 of the housing 20 is described, but the other side surface 22 is not described below.

The lever 40 is made of synthetic resin and includes, as shown in FIG. 1, two cam plates 41, each of which is formed with a cam groove 42. An operating portion 43 is provided for coupling the cam plates 41. As shown in FIG. 3, each cam plate 41 is provided with a shaft hole 44 through which the support shaft 23 of the housing 20 is disposed. Each cam groove 42 has an entrance 42A that is open forward when the lever 40 is at the initial position and is arched from the entrance 42A toward a back end part 42B to approach the shaft hole 44. Further, a holding projection 42C is provided at the entrance 42A of the cam groove 42 for holding a cam pin 61 provided on the mating housing 60.

When the housing 20 and the mating housing 60 are connected lightly, the cam pins 61 enter the entrances 42A of the cam grooves 42 and move over the holding projections 42C to be locked, as shown in FIG. 3. Thus, the cam pins 61 are held not to come out from the entrances 42A. If the lever 40 is rotated in the clockwise direction from this state, the connection of the housing 20 and the mating housing 60 proceeds by a cam action based on the engagement of the cam pins 61 and the cam grooves 42. When the lever 40 reaches the first connection position, the connection of the housing 20 and the mating housing 60 is completed and the cam pins 61 reach positions immediately before the back end parts 42B of the cam grooves 42. Thus, the cam pins 61 are not in contact with the back end parts 42B of the cam grooves 42.

Figure 5:
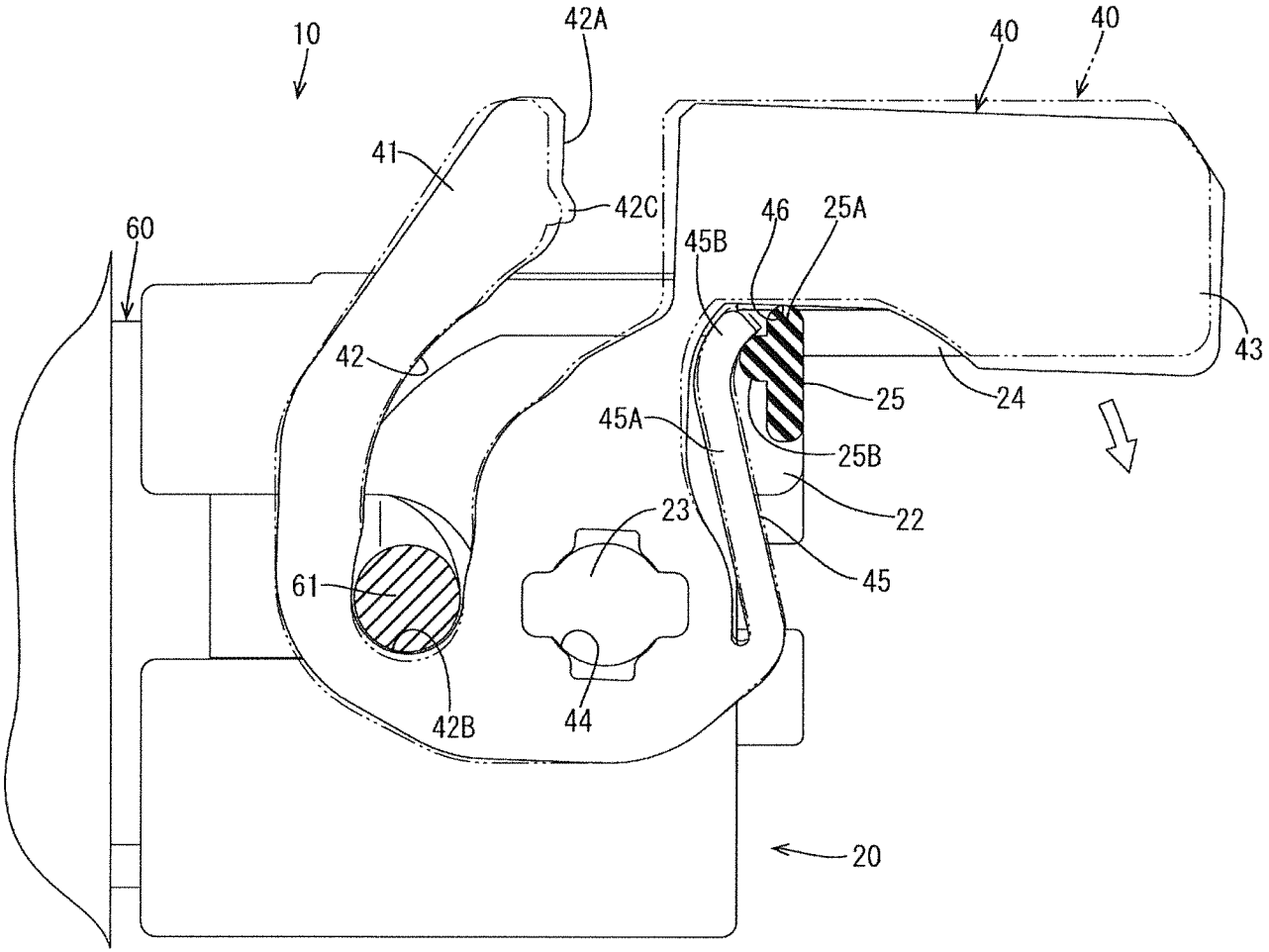
FIG. 5 is a section of the lever-type connector showing a state where the lever is at a second connection position.

Further, as shown in FIG. 3, the housing 20 includes a lever lock 24 for holding the lever 40 movably between the first and second connection positions. The lever lock 24 includes an arm 24A located on an upper surface side of the housing 20 and cantilevered rearward and a locking portion 24B provided on a rear end of the arm 24A. As shown in FIGS. 4 and 5, a return of the lever 40 to the initial position is prevented by the operating portion 43 being locked by the locking portion 24B of the lever lock 24 when the lever 40 is between the first and second connection positions.

As shown in FIG. 3, a deflecting portion 45 is provided on the outer peripheral surface of the cam plate 41 of the lever 40. The deflecting portion 45 of this embodiment is a leaf spring, cantilevered toward the operating portion 43 from the vicinity of the shaft hole 44 and is deflectable in a plate surface direction (direction along a surface perpendicular to a plate thickness direction) of the cam plate 41. As shown in FIG. 3, the deflecting portion 45 is composed of a straight portion 45A extending up at an angle of about 30° with respect to a shown upper part of the outer peripheral surface of the cam plate 41, and an arcuate portion 45B arcuately extending up from a tip of the straight portion 45A.

A projection 25 is provided in an upper part of the rear end of the side surface of the housing 20. This projection 25 is composed of a movement stopping portion 25A extending in the shown vertical direction and a stopper 25B projecting toward the deflecting portion 45 from the vicinity of a center of the movement stopping portion 25A. As shown in FIG. 3, any of both upper and lower end parts of the movement stopping portion 25A and the stopper 25B has a semicircular cross-section. The movement stopping portion 25A is provided on a shown upper side of the outer peripheral surface of the projection 25, and the stopper 25B is provided on a shown left side of the outer peripheral surface of the projection 25. The stopper 25B contacts the arcuate portion 45B of the deflecting portion 45 and starts being deflected halfway through a movement of the lever 40 from the initial position toward the first connection position. Thus, the arcuate portion 45B of the deflecting portion 45 is deflectable in a rotating direction of the lever 40.

As shown in FIG. 4, when the lever 40 is at the first connection position, the connection of the housing 20 and the mating housing 60 is completed and the arcuate portions 45B of the deflecting portions 45 are in contact with the stoppers 25B of the projections 25 and base end sides of the straight portions 45A are deflected. Thus, reaction forces are generated on the base end sides of the straight portions 45A and the lever 40 is biased from the first connection position toward the initial position by these reaction forces, but is held at the first connection position by the lever lock 24. At this time, a part of the lever 40 facing the movement stopping portion 25A serves as a receiving portion 46. The receiving portion 46 is not in contact with the movement stopping portion 25A and the cam pins 61 are also not in contact with the back end parts 42B of the cam grooves 42.

A chain double-dashed line shown in FIG. 5 indicates the lever 40 at the first connection position, and a solid line indicates the lever 40 at the second connection position. A state is shown where the connected state of the housing 20 and the mating housing 60 remains unchanged from the first connection position and only the lever 40 rotates when the lever 40 is at the second connection position. The receiving portion 46 of the lever 40 is in contact with the movement stopping portions 25A of the projections 25, so that the lever 40 cannot be rotated any further in a shown arrow direction.

Figure 6:
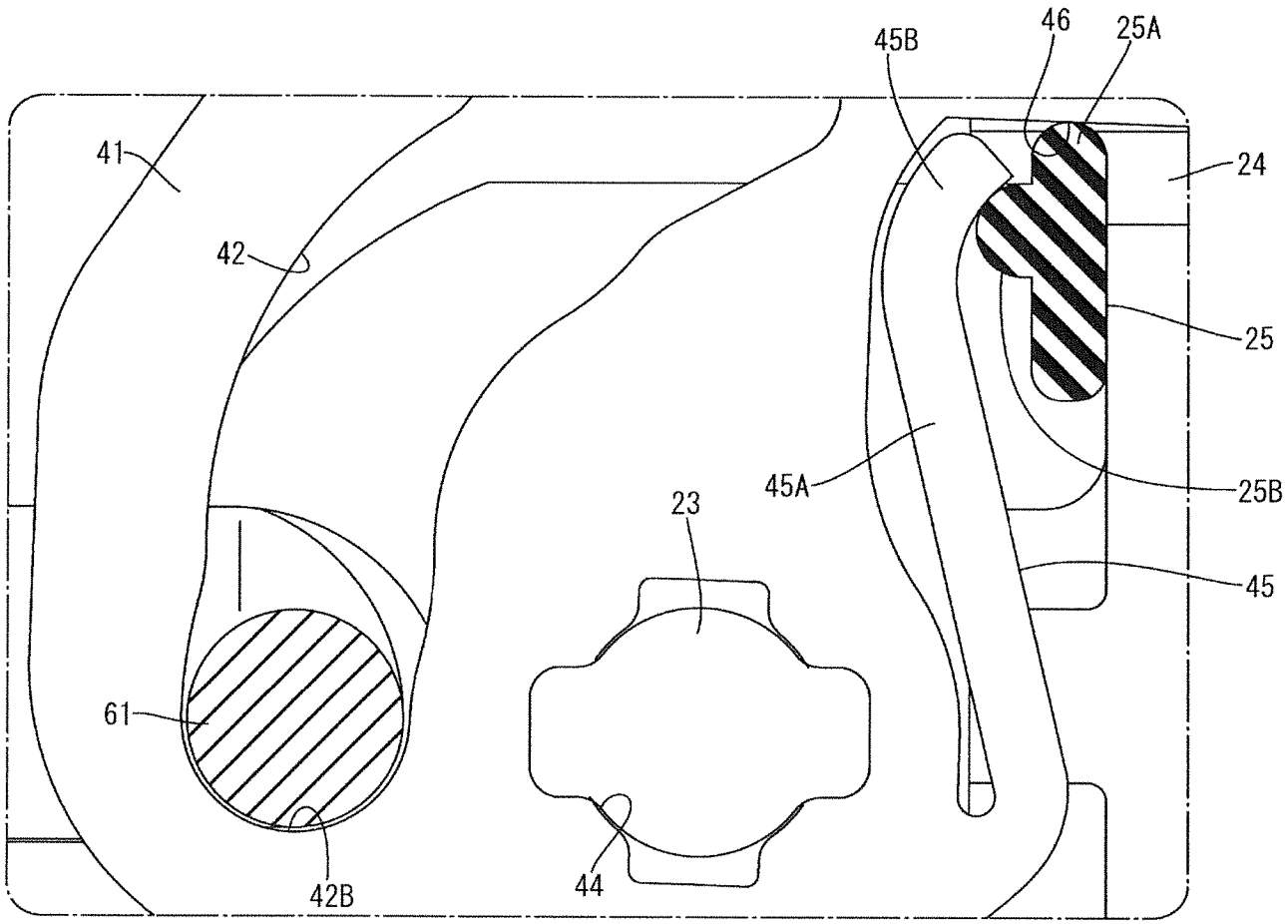
FIG. 6 is an enlarged section enlargedly showing a part of FIG. 5.

When the lever 40 is at the second connection position, the lever 40 is not in contact with the arm 24A of the lever lock 24, thereby preventing the arm 24A from being deformed due to stress applied to the arm 24A. Specifically, as shown in FIG. 6, the cam pin 61 is not in contact with the back end part 42B of the cam groove 42, and the cam pin 61 is prevented from being broken due to stress applied thereto. Thus, at the time of an overstroke of the lever 40 from the first connection position to the second connection position, stress from the lever 40 is applied only to the movement stopping portions 25A of the projections 25. Note that since the receiving portion 46 is also not in contact with the arcuate portions 45B of the deflecting portions 45, it can be also avoided that the deflecting portions 45 are erroneously detached from the stoppers 25B.

If the lever 40 is released after an overstroke thereof to the second connection position, the lever 40 rotates in the counterclockwise direction from the second connection position due to reaction forces of the deflecting portions 45 and is held at the first connection position by the lever lock 24. That is, the lever 40 is held in a rotatable state between the first and second connection positions by the lever lock 24.

This embodiment is configured as described. Next, functions of this embodiment are described. First, connecting and separating operations of the housing 20 and the mating housing 60 are described. The lever 40 is set at the initial position and the housing 20 and the mating housing 60 are connected lightly. Then, as shown in FIG. 3, the cam pins 61 enter the entrances 42A of the cam grooves 42 and are held at the entrances 42A by the holding projections 42C. When the lever 40 is rotated in the clockwise direction from this state, the can pins 61 move toward the back ends 42B along the cam grooves 42 and the connection of the housing 20 and the mating housing 60 proceeds. During this time, the deflecting portions 45 contact the stoppers 25B according to the rotation of the lever 40. By continuing the rotation of the lever 40, the deflecting portions 45 start being deflected by the stoppers 25B.

The connection of the housing 20 and the mating housing 60 is completed when the lever 40 is rotated to the first connection position, and the lever 40 is held by the lever lock 24, as shown in FIG. 4. If the rotation of the lever 40 is stopped immediately before the lever 40 reaches the first connection position, the lever 40 is returned in the counter-clockwise direction by reaction forces of the deflecting portions 45. Thus, it is easily detected that the housing 20 and the mating housing 60 are connected incompletely. Further, when the lever 40 is rotated to the second connection position due to an overstroke, the receiving portion 46 of the lever 40 contacts only the movement stopping portions 25A of the projecting portions 25, as shown in FIG. 5. Thus the rotation of the lever 40 is stopped and the deformation of the lever lock 24 is prevented.

As described above, in this embodiment, the deflecting portions 45 contact the projections 25 halfway through the movement of the lever 40 from the initial position to the first connection position. Thus, the deflecting portions 45 are deflected by the projections 25 as the lever 40 is moved farther, and the lever 40 is held by the lever lock 24 when the lever 40 reaches the first connection position.

The lever 40 is returned toward the initial position by the reaction forces of the deflecting portions 45 if the movement of the lever 40 is stopped before the first connection position is reached to indicate that the lever 40 has not reached the first connection position. On the other hand, if a lever operating force is large and the lever 40 reaches the second connection position (in the case of an overstroke), the receiving portion 46 of the lever 40 contacts the projections 25, thereby stopping the movement of the lever 40. In this case, the lever 40 does not contact the lever lock 24, and the lever lock 24 can be prevented from being deformed due to stress applied thereto. Thus, it can be prevented that the lever held by the lever lock 24 is released and the lever 40 is returned toward the initial position.

The projection 25 may include the stopper 25B for deflecting the deflecting portion 45 and the movement stopping portion 25A for stopping the movement of the lever 40 while contacting the receiving portion 46, and the stopper 25B and the movement stopping portion 25A may be provided at different positions on the outer peripheral surface of the projection 25. According to this configuration, both the stopper 25B and the movement stopping portion 25A are provided on the projecting portion 25. Therefore, miniaturization is possible as compared to the case where the stopper 25B and the movement stopping portion 25A are provided on different parts.

The lever 40 may include the two cam plates 41 having the deflecting portions 45 and the operating portion 43 coupling the two cam plates 41, and the lever 40 may be held with the operating portion 43 locked by the lever lock 24. According to this configuration, the lever lock portion 24 is provided according to the position of the operating portion 43. Thus, a case where the cantilevered lever lock 24 has to be provided as in this embodiment is assumed. Even in such a case, no stress is applied to the lever lock 24, and the deformation of the lever lock portion 24 can be prevented.

The invention is not limited to the above described and illustrated embodiment. For example, the following modes are also included.

Although the rotary lever 40 is illustrated in the above embodiment, a slide lever may be employed. Further, although the substantially U-shaped lever 40 is illustrated, a lever in the form of a single plate may be employed.

Although the stopper 25B and the movement stopping portion 25A are integrally provided in the above embodiment, a stopper and a movement stopping portion may be separately provided.

Although the operating portion 43 is locked by the lever lock 24 in the above embodiment, a locking portion may be provided on a cam plate and a housing may be provided with a lever lock lockable to this locking portion.

LIST OF REFERENCE SIGNS

10 lever-type connector
20 housing
24 lever lock
25 projection
25A movement stopping portion
25B stopper
40 lever
41 cam plate
43 operating portion
45 deflecting portion
46 receiving portion

The invention claimed is:

1. A lever-type connector, comprising:

a housing; and a lever mounted on the housing movably to an initial position, a first connection position and a second connection position more distant from the initial than the first connection position;

wherein:

the lever includes a deflecting portion deflectable in a moving direction of the lever;

the housing includes a projecting portion configured to start contacting the deflecting portion halfway through a movement of the lever from the initial position to the first connection position and deflect the deflecting portion until the second connection position is reached and a lever lock portion configured to hold the lever in a movable state between the first connection position and the second connection position; and the lever includes a receiving portion configured to contact not the lever lock portion, but the projecting portion when the second connection position is reached.

2. The lever-type connector of claim 1, wherein the projecting portion includes a stopper configured to deflect the deflecting portion and a movement stopping portion configured to stop a movement of the lever while contacting the receiving portion, and the stopper and the movement stopping portion are respectively provided at different positions on an outer peripheral surface of the projecting portion.

3. The lever-type connector of claim 2, wherein the lever includes a pair of cam plates having a pair of the deflecting portions and an operating portion coupling the pair of cam plates, and the lever is held with the operating portion locked by the lever lock portion.

4. The lever-type connector of claim 1, wherein the lever includes a pair of cam plates having a pair of the deflecting portions and an operating portion coupling the pair of cam plates, and the lever is held with the operating portion locked by the lever lock portion.

* * * * *